US006762557B2

(12) United States Patent
Kanzaki et al.

(10) Patent No.: US 6,762,557 B2
(45) Date of Patent: Jul. 13, 2004

(54) SUPER-HIGH PRESSURE DISCHARGE LAMP OF THE SHORT ARC TYPE

(75) Inventors: Yoshitaka Kanzaki, Himeji (JP); Toyohiko Kumada, Himeji (JP); Masanobu Komiya, Himeji (JP)

(73) Assignee: Ushiodenki Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/167,572

(22) Filed: Jun. 13, 2002

(65) Prior Publication Data

US 2002/0190654 A1 Dec. 19, 2002

(30) Foreign Application Priority Data

Jun. 13, 2001 (JP) ..... 2001-178300
Jun. 13, 2001 (JP) ..... 2001-178301

(51) Int. Cl.[7] ..... H01J 17/18; H01J 61/36

(52) U.S. Cl. ..... 313/623; 313/631; 313/634; 313/639

(58) Field of Search ..... 313/623, 631, 313/634, 639, 636

(56) References Cited

U.S. PATENT DOCUMENTS

| | | | | |
|---|---|---|---|---|
| 5,109,181 A | | 4/1992 | Fischer et al. | |
| 5,497,049 A | | 3/1996 | Fischer | |
| 5,877,591 A | * | 3/1999 | Nagata et al. | 313/634 |
| 6,132,279 A | | 10/2000 | Horiuchi et al. | |
| 6,307,321 B1 | * | 10/2001 | Honda et al. | 313/634 |
| 2002/0031975 A1 | | 3/2002 | Kanzaki et al. | 445/43 |

FOREIGN PATENT DOCUMENTS

| | | |
|---|---|---|
| DE | 36 38 857 A1 | 5/1987 |
| DE | 92 06 727 U | 7/1992 |
| DE | 198 12 298 A1 | 10/1998 |
| EP | 0 338 637 A2 | 10/1989 |
| EP | 0 576 071 A1 | 12/1993 |
| JP | 10-149801 | 6/1998 |
| JP | 10-289690 | 10/1998 |
| JP | 11-176385 | 7/1999 |

* cited by examiner

*Primary Examiner*—Nimeshkumar D. Patel
*Assistant Examiner*—Kevin Quarterman
(74) *Attorney, Agent, or Firm*—Nixon Peabody LLP; David S. Safran

(57) ABSTRACT

An arrangement with relatively high pressure tightness in a super-high pressure mercury lamp which is operated with an extremely high mercury vapor pressure is achieved the following:

an emission part contains a pair of opposed electrodes, each of which has a side section and an end face, and which is filled with at least 0.15 mg/mm$^3$ mercury;

side tube parts made of quartz glass extend from opposite sides of the emission part and the side section and end face of a respective electrode is partially hermetically enclosed is each side part;

the electrodes are arranged in side tube parts with a small intermediate space formed between the side sections and the end faces of the electrodes and the quartz glass of which the side tube parts is made; and the side parts of the electrodes have at least partially concave-convex areas in the side tube parts. Alternatively or in addition, each side section is joined to a metal foil which extends axially beyond the end face of the respective electrode and the end face of each metal foil adjoins the end face of the respective electrode at an acute angle.

17 Claims, 8 Drawing Sheets

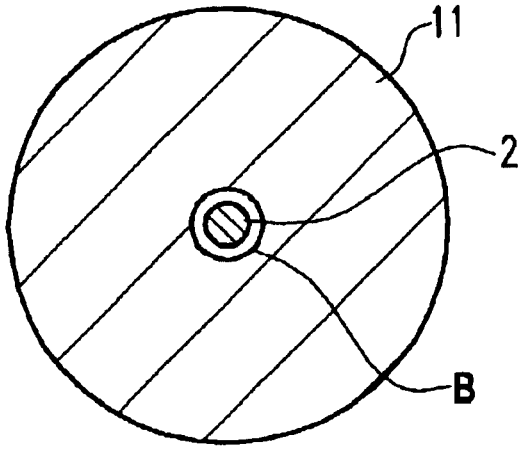
Fig.3
Fig.4(a)
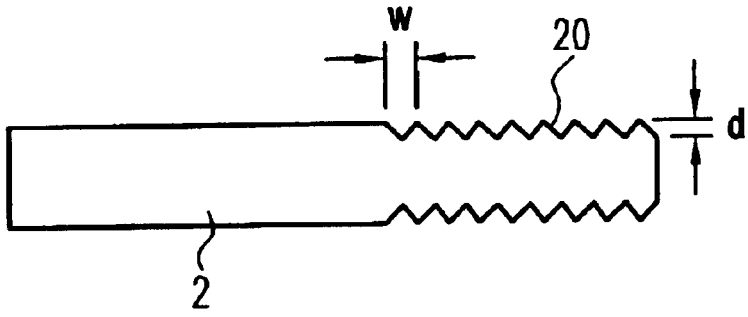
Fig.4(b)
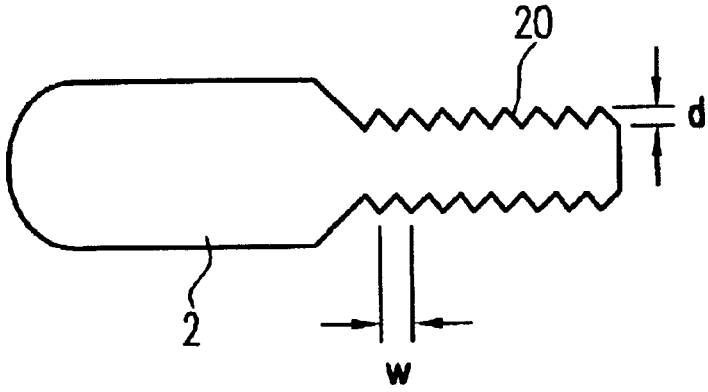

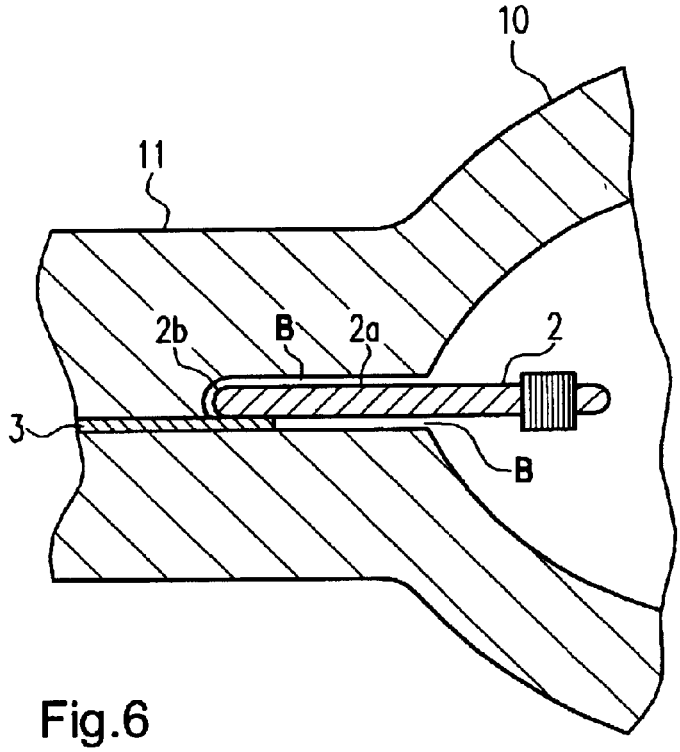
Fig.6
Fig.7(b)
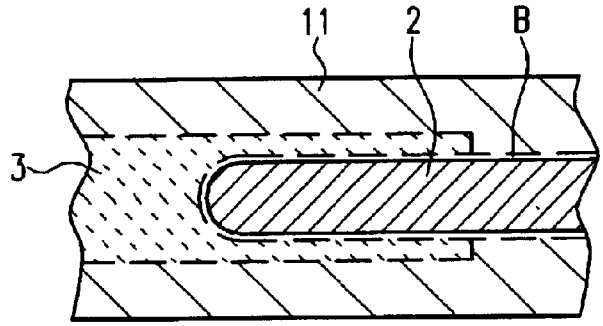
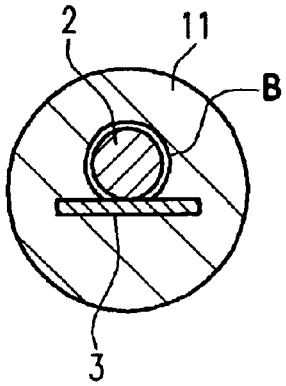
Fig.7(c)
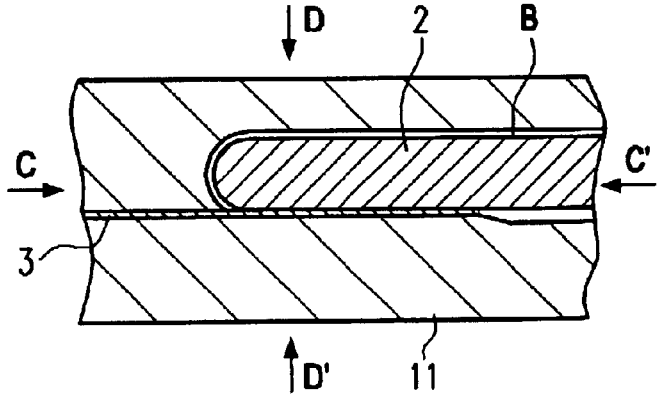
Fig.7(a)

SUPER-HIGH PRESSURE DISCHARGE LAMP OF THE SHORT ARC TYPE

BACKGROUND OF THE INVENTION

1. Field of the Invention

The invention relates to a super-high pressure discharge lamp of the short arc type in which the mercury vapor pressure during operation is at least equal to 150 atm. The invention relates especially to a super-high discharge lamp of the short arc type which is used as the backlight of a liquid crystal display device and a projector device using a DMD (digital mirror device) and a DLP (digital light processor) or the like.

2. Description of Related Art

In a projector device of the projection type there is a demand for illumination of the images uniformly onto a rectangular screen and with sufficient color reproduction. The light source is thus a metal halide lamp which is filled with mercury and a metal halide. Furthermore, recently smaller and smaller metal halide lamps and more and more often spot light sources have been produced and lamps with extremely small distances between the electrodes have been used in practice.

Against this background, recently, instead of metal halide lamps, lamps with an extremely high mercury vapor pressure, for example, of 150 atm, have been proposed. Here, the increased mercury vapor pressure suppresses broadening of the arc (the arc is compressed) and a major increase of the light intensity is desired. One such super-high pressure discharge lamp is disclosed in U.S. Pat. No. 5,109,181 (JP-OS HEI 2-148561) and U.S. Pat. No. 5,497,049 (JP-OS HEI 6-52830).

In one such super-high pressure discharge lamp, the pressure within the arc tube during operation is extremely high. In the side tube parts which extend from the two sides of the emission part, it is therefore necessary to arrange the quartz glass comprising these side tube parts, the electrodes and the metal foils for power supply in a sufficient amount, and moreover, almost directly tightly adjoining one another. When they are not adjoining one another tightly enough, the added gas leaks or cracks form. In the process of hermetic sealing of the side tube parts, therefore the quartz glass is heated, for example, at a high temperature of 2000° C., and in this state, the quartz glass with a great thickness is gradually subjected to shrinking (a so-called shrink seal) or a pinch seal. In this way, the adhesive property of the side tube parts is increased.

However, if the quartz glass is heated up to an excessively high temperature, the disadvantage occurs that, after completion of the discharge lamp, the side tube parts are easily damaged, even if the adhesive property of the quartz glass to the electrodes or metal foils is increased.

It can be imagined that the cause of this disadvantage is the following:

After heat treatment, in the stage in which the temperature of the side tube parts is gradually reduced, as a result of differences between the coefficient of expansion of the material (tungsten) comprising the electrodes, and the coefficient of expansion of the material (quartz glass) comprising the side tube parts, there is a relative difference in the amount of expansion. This causes the formation of cracks in an area in which the two come into contact with one another. These cracks are very small, but together with the super-high pressure state during lamp operation they lead to growth of the cracks; this causes damage to the discharge lamp.

In order to eliminate this disadvantage, the arrangement shown in FIG. 11 was proposed. Here, part of the discharge lamp is shown in an enlarged view. The emission part 10 adjoins a side tube part 11 in which an electrode 2 is connected to the metal foil 3. A coil component 5 is wound around the electrode 2 which has been installed in the side tube part 11. This arrangement of the coil component 5 which has been wound around the electrode 2 reduces the stress which is exerted on the quartz glass as a result of the thermal expansion of the electrode 2. This arrangement is described, for example, in Japanese patent disclosure document HEI 11-176385.

However, in reality, there was the disadvantage that, in the vicinity of the electrode 2 and the coil component 5, cracks K remain even if the thermal expansion of the electrode 2 is relieved by this arrangement. These cracks K are very small, but there are often cases in which they lead to damage of the side tube part 11 when the mercury vapor pressure of the emission part 10 is roughly 150 atm. Furthermore, in recent years, there has been a demand for a very high mercury vapor pressure of 200 atm, and moreover, up to 300 atm. At such a high mercury vapor pressure, the growth of cracks is accelerated during lamp operation. As a result there was the disadvantage that damage of the side tube part 11 clearly occurs. This means than the cracks gradually become larger during lamp operation with a high mercury vapor pressure, even if the cracks K were extremely small at the start. It can be stated that this is a new technical task which is never present in a mercury lamp with a vapor pressure during operation from roughly 50 atm to roughly 100 atm, or no more than roughly 50 atm to roughly 100 atm.

Two of the present applicants have already proposed the arrangement shown in FIG. 12 in commonly-owned U.S. patent application Ser. No. 09/874,231 (corresponding to Japanese Patent Application 2000-168798). In this arrangement. an emission part 10 has a side tube part 11 in which an electrode 2 is connected to a metal foil 3. The electrode 2 with its side 2*a* and its end face 2*b* is located in an extremely small intermediate space B out of contact with the quartz glass. This intermediate space arrangement makes it possible to eliminate the above described defect of crack formation if the intermediate space can be formed completely precisely. However, it has been found that, in reality, completely precise formation of this intermediate space is difficult. Specifically, it is disclosed that the intermediate space is formed by applying a vibration to the electrode. However, in practice, the intermediate space cannot be adequately produced by vibration alone.

Furthermore, the arrangement shown in FIG. 12 yielded another, new disadvantage. FIGS. 13(*a*), 13(*b*), and 13(*c*) are each an enlarged representation of the encircled area A of FIG. 12. FIG. 13(*a*) shows the area A of FIG. 12 in an identical enlarged representation. FIG. 13(*b*) is a cross section in which the cross section C—C' as shown in FIG. 13(*a*) is viewed from the top (in direction of arrow D), the position of foil 3 being shown in phantom outline. FIG. 13(*c*) shows cross section D—D' of FIG. 13(*a*) viewed from the left side (in the direction of arrow C). As shown in FIGS. 13(*a*) to 13(*c*), the intermediate space B is present from the side 2*a* of the electrode 2 as far as the end face 2*b*. However, on the end face 2*b* of the electrode 2, there is an undesirable wedge-shaped intermediate space X.

FIG. 14 shows the intermediate space X in an enlarged representation. Since the intermediate space X is directly connected via the intermediate space B to the emission part 10, the high internal pressure which forms within the emission part 10 (of at least 150 atm) is exerted in the same way.

This high pressure is intensely exerted in the wedge-shaped intermediate space X in the directions P3 and P4 of the arrows shown in FIG. 14, and this phenomenon ultimately leads to detachment of the metal foil 3 from the quartz glass. This results in damage to the discharge lamp. It can furthermore be stated that this phenomenon is a characteristic technical task which arises in a discharge lamp which has an arrangement in which the emission part and the end face of the electrode are coupled to one another by an intermediate space, and which has an extremely high internal pressure that is greater than or equal to 100 atm, 150 atm, 200 atm, and moreover, at least 300 atm, as in the invention.

SUMMARY OF THE INVENTION

The invention was devised to eliminate the above described disadvantage in the prior art, a primary object of the invention being to devise an arrangement with relatively high pressure tightness in a super-high pressure mercury lamp which is operated with an extremely high mercury vapor pressure.

This object is achieved in accordance with the invention in a super-high pressure discharge lamp of the short arc type which comprises the following:

an emission part in which there are a pair of opposed electrodes and which is filled an amount of mercury at least equal to 0.15 mg/mm$^3$ mercury and side tube parts of quartz glass which extend from opposite sides of the emission part and in which the electrodes are partially hermetically sealed, wherein the electrodes are arranged in the side tube parts a respective extremely small intermediate space formed between the sides and the end faces of the electrodes and the quartz glass of the side tube parts, and that the electrodes are provided with concave-convex parts.

The object is furthermore achieved in accordance with the invention by the above described extremely small space being formed of a size that, as a result of the difference between the coefficient of expansion of the material comprising the electrodes and the coefficient of expansion of the material comprising the side tube parts, the electrodes are not constricted in the axial direction, but can freely expand.

The object is furthermore achieved according to the invention by the above described concave-convex parts having a depth of from 1.0 micron to 100 microns.

The object is furthermore achieved by the invention in a super-high pressure discharge lamp of the short arc type which comprises:

an emission part in which there are a pair of opposed electrodes and which is filled with at least 0.15 mg/mm$^3$ of mercury and side tube parts of quartz glass which extend from both sides of the emission part and in which metal foils which are connected to the electrodes are hermetically sealed, wherein the electrodes are arranged such that, in the above described side tube parts, an extremely small intermediate space is formed between the sides and the end faces of the electrodes and the quartz glass comprising the side tube parts, the end faces of the electrodes and the metal foils forming an acute-angled arrangement in which the quartz glass is located.

This object is moreover achieved in accordance with the invention by the above described acute-angled arrangement having an angle of less than or equal to 70°.

The above described arrangement makes it possible to avoid completely or essentially completely the extremely small cracks which form in the side tube parts in the super-high pressure discharge lamp of the short arc type of the invention.

The reason for this is that, for the electrodes located in the side tube parts (upholding parts of the electrodes), there is an intermediate space between the electrode surfaces (including the end faces) and the quartz glass so that the quartz glass and the electrodes do not directly tightly adjoin one another.

In this arrangement, the surfaces of the electrodes are not in contact with the quartz glass. Even if the electrodes move relative to the quartz glass, no cracks due to this motion form between them.

Furthermore, according to the invention, the electrode surfaces are provided with concave-convex parts in order to make these intermediate spaces simple and moreover more reliable.

The technical explanation that formation of the concave-convex shape leads to reliable formation of the intermediate space is not always apparent. As a result of thorough research, the applicant has arrived at the following conclusions:

As is also disclosed in the above described commonly-owned, co-pending U.S. application, in the production process for forming the intermediate space in the last segment of the process of hermetic sealing, an impact is applied to the electrodes. It is assumed that the quartz glass which is in the molten state and which is present in the concave parts is pressed more easily to the outside during the impact if concave-convex parts are present and that the intermediate space is reliably formed by this pressing-out.

Furthermore, the inventors have conducted thorough studies to eliminate the disadvantage of the wedge-shaped space and as a result they have developed a concept for the shape of the end faces of the electrodes.

The invention is explained in detail below using several embodiments shown in the drawings.

BRIEF DESCRIPTION OF THE DRAWINGS

FIG. 3 is a cross section taken along line A'—A' as shown in FIG. 2;

FIGS. 4(*a*) & 4(*b*) each schematically show an arrangement of the electrode in accordance with the invention;

FIG. 6 shows a partial view of a super-high pressure discharge lamp of the short arc type in accordance with another embodiment of the invention;

FIGS. 7(*a*), 7(*b*), & 7(*c*) each show a partial cross-sectional the FIG. 6 embodiment of the invention;

DETAILED DESCRIPTION OF THE INVENTION

Figure 1:
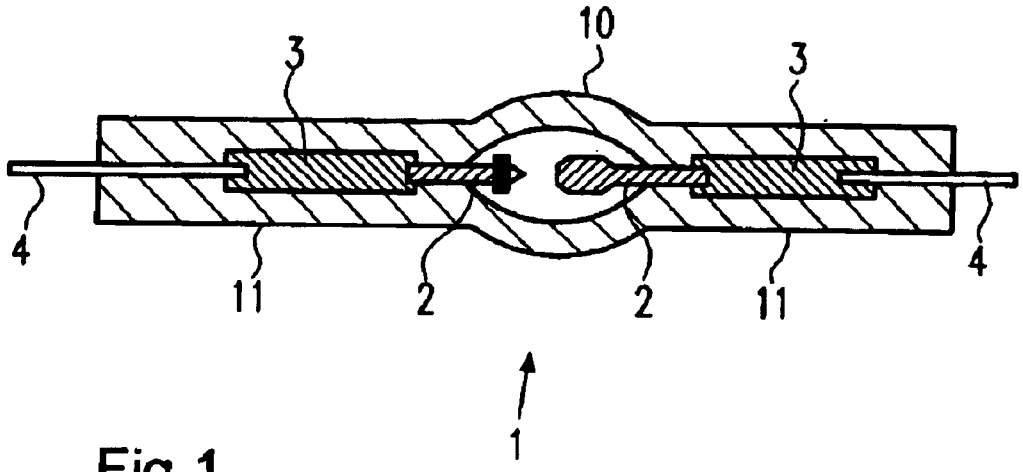
FIG. 1 a cross-sectional view of a super-high pressure discharge lamp of the short arc type.

A super-high pressure discharge lamp of the short arc type in accordance with the invention is described below. First, the overall arrangement of the discharge lamp is described using FIG. 1. In essentially the middle of the discharge lamp 1 is an emission part 10 which is made of quartz glass and has side tube parts 11 on opposite ends that are hermetically sealed.

In the emission part 10, there are a pair of opposed tungsten electrodes 2, for example, that are separated by a distance of at most equal to 2.5 mm. A metal foil 3 is welded to one end of each electrode 2. The metal foil 3 and part of the electrode 2 are installed in the side tube part 11 and are hermetically sealed. An outer lead 4 is connected to the other end of the metal foil 3. The tip of the electrode 2 is wound with a coil. The reason for this to improve the operation starting property. Here, tungsten is wound around the tip four to five times.

The emission part 10 contains as the emission substance mercury, and furthermore, a rare gas, such as argon, xenon or the like, as the operation starting gas. The amount of mercury added is an amount in which the vapor pressure during stable operation is at least equal to 150 atm, preferably is greater than or equal to 200 atm, and more preferably, is at least 300 atm, computed and added one at a time. For example, in the case in which the mercury vapor pressure is greater than or equal to 150 atm, the amount of mercury added is greater than or equal to 0.15 mg/mm$^3$.

Figure 2:
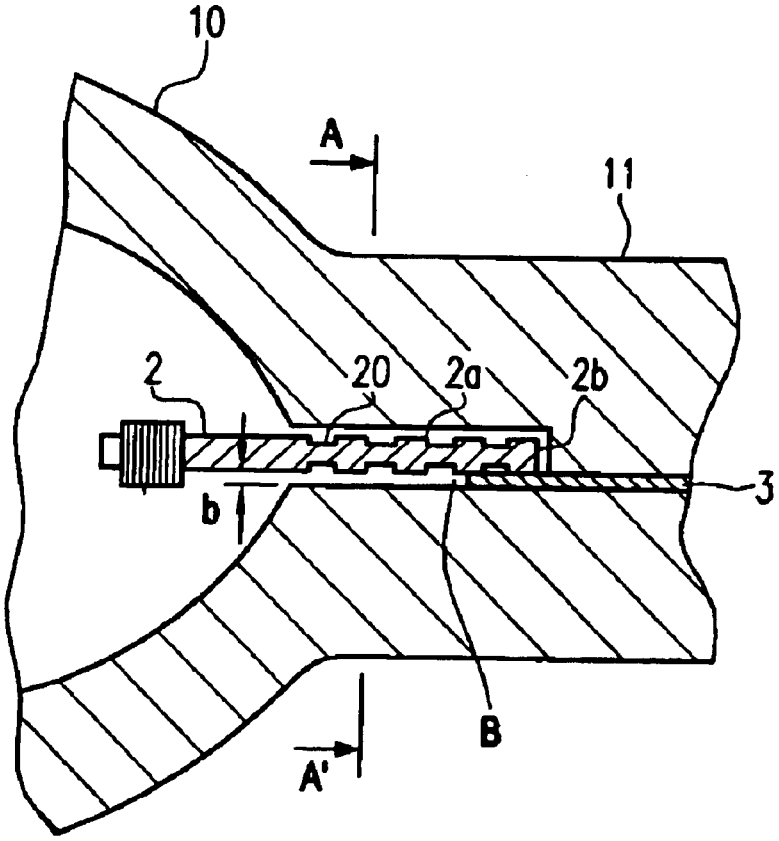
FIG. 2 shows an enlarged partial view of a super-high pressure discharge lamp of the short arc type in accordance with the invention.
Figure 5A:
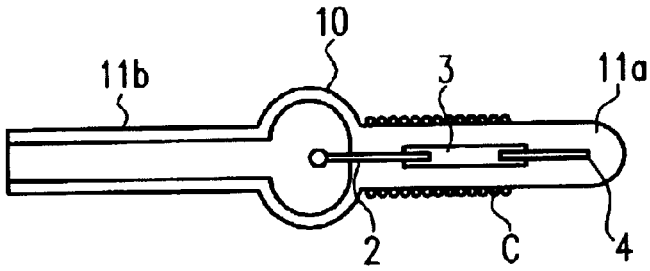
FIGS. 5(*a*) to 5(*d*) each schematically show a step in a process for producing a super-high pressure discharge lamp of the short arc type according to the invention.
Figure 5B:
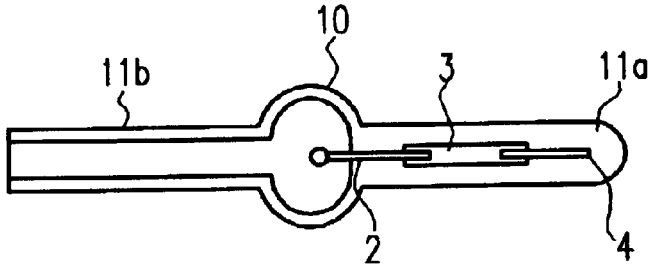
Figure 5C:
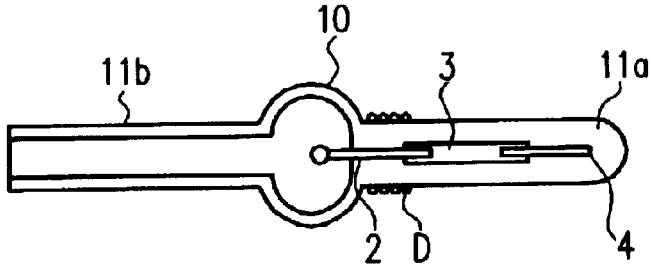
Figure 5D:
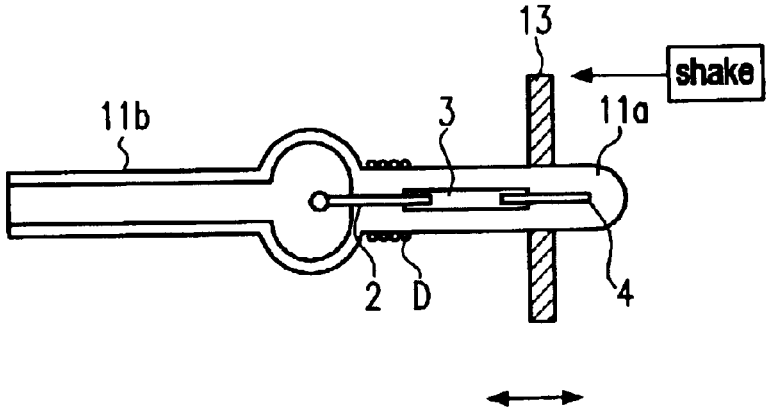

The invention is described specifically below. FIG. 2 relates to a first embodiment of the invention and shows the boundary area of the emission part 10 and the side tube part 11 in an enlarged representation. FIG. 3 is a cross section corresponding to line A—A' as shown in FIG. 2. The intermediate space B and the concave-convex part 20 in FIG. 2 and FIG. 3 are extremely small in practice, but are shown exaggerated in the drawings to facilitate the explanation. It is also noted that the terms "concave" and "convex" as used herein are not intended to be restricted to spherically or arcuately curved surfaces but rather as used in the term "concave-convex" is intended to describe a series of surfaces that are alternately displaced inward and outward with respect to each other including the inward and outward series of steps shown in FIG. 2 and the zig-zag configurations that are shown in FIGS. 4(*a*) & 4(*b*).

In the side tube part 11, the electrode 2 is welded to the metal foil 3. In the other area between the electrode 2 and the quartz glass comprising the side tube part 11, there is an intermediate space B. Specifically, the side 2*a* of the electrode and the end face 2*b* on the hermetically sealed side are not in contact with the side tube part 11 (the quartz glass).

Here, the intermediate space B is fixed in the respect that, as a result of the difference between the coefficient of expansion of the material comprising the electrodes, and the coefficient of expansion of the material comprising the side tube parts, the electrodes are not constricted in the axial direction, but can freely expand. In the case in which the electrodes are made of tungsten and the side tube parts are made of quartz glass, the width b of the intermediate space B is chosen in the range from 6 microns to 16 microns. The length of the intermediate space B in the lengthwise direction of the electrode is 2 mm to 5 mm. The outside diameter of the side tube part of the electrode is for example 0.3 mm to 1.5 mm.

FIGS. 4(*a*) & 4(*b*) show two specific arrangements for the electrodes 2. In FIG. 4(*a*), the electrode has the same diameter from the end to the tip. In FIG. 4(*b*), the area which projects into the emission space is thicker than the part in the hermetically sealed area. Furthermore, electrodes with different shapes can be used. The tip on the side of the emission space of the electrode can be flat, as shown in FIG. 4(*a*), or curved, as shown in FIG. 4(*b*). Furthermore, the tip can also have other shapes, such as a cone shape and the like. The portion of the electrode 2 which corresponds to the side tube part is provided with a concave-convex part 20. The concave section between two elevations has a width W and a depth d. As shown in FIGS. 4(*a*) & 4(*b*), a zig-zag shape can be used or the square/rectangular shape shown in FIG. 2 can be used. Furthermore, other shapes, such as a curved (rounded) shape or a corrugated shape can be used. The depth d of the concave-convex area 20 is, for example, 1 micron to 100 microns. This concave-convex part 20 can be formed by turning, cylindrical grinding or the like.

A process for producing a super-high pressure discharge lamp of the short arc type according to the invention is described below. FIGS. 5(*a*) to 5(*d*) show a series of production processes. FIG. 5(*a*) shows the process of hermetic sealing. FIG. 5(*b*) shows the cooling process. FIG. 5(*c*) shows the heat-up process. FIG. 5(*d*) shows the vibration process. The electrode 2 is, as was described above, provided with a concave-convex part. But in FIGS. 5(*a*) to (*d*) the convex-concave part is advantageously omitted for describing the production processes.

First, the process of hermetic sealing as shown in FIG. 5(*a*) is described. In one of the side tube parts 11, specifically the side tube part 11*a*, of a glass bulb, of which an emission part 10 and the side tube parts 11 are formed, an electrode module is inserted in which an electrode 2, a metal foil 3 and an outer lead pin 4 are made integral with one another. Here, the tip of the electrode 2 projects into the emission part 10. The base part of the electrode 2 and the metal foil 3 are positioned in the side tube part 11. The area C of the side tube part 11*a* which surrounds the base part of the electrode 2 and metal foil 3 is heated up to a temperature which is at least equal to the softening point of this side tube part 11*a*. Specifically, the softening point in the case in which the side tube part is made of quartz glass is 1680° C. It is heated at roughly 2000° C. with a gas burner.

In this process of hermetic sealing, the end of the side tube part 11*a* is already closed. The inside of the glass bulb is exposed to a negative pressure via an open end of the other side tube part 11*b*, for example, up to 100 torr. When the side tube part 11*a* is heated up, therefore the diameter of this part is reduced. In this way, the electrode 2 and the metal foil 3 are hermetically sealed against one another. Besides the process (shrink seal) in which the inside of the glass bulb is exposed to a negative pressure, the side tube part 11 can also be hermetically sealed after heating with pincers.

Next, the cooling process as shown in FIG. 5(*b*) is described. Following the above described process of hermetic sealing, the side tube part 11*a* is cooled. This cooling takes place by forced cooling or natural cooling and the side tube part 11*a* is cooled, for example, down to 1200° C.

This cooling process shifts the electrode 2 and the side tube part 11*a* into a state which they are welded to one another in one section. However, this welding does not take place on the entire surface of the electrode 2. The reason for this is that the material of which the electrode is made, for example, tungsten, and the material of which the side tube part is made, for example, quartz glass, have different coefficients of expansion and that part of the area in which the electrode 2 and the side tube part 11 are welded to one another (in which they are welded to one another in the process of hermetic sealing) detaches. When this detachment takes place, the above described extremely small cracks K form.

Next, the heat-up process as shown in FIG. 5(*c*) is described. Following the above described cooling process, the area D in the drawings is heated again. This heating is carried out, for example, with a gas burner until the material of which the side tube part 11 is made, for example, quartz glass, passes into a plastic flow state and comes into contact with the electrode 2. The electrode 2 and the material of the side tube part 11 can move relative to one another. In this re-heating process, only the area D of the side tube part 11*a* is heated again, not the entire metal foil 3. Therefore, there is no effect on the hermetic sealing of the metal foil 3 to the side tube part 11. This re-heating can eliminate the extremely small cracks which were present in the vicinity of the electrode 2.

Next, the vibration process as shown in FIG. 5(*d*) is described. After completion of the above described heating process, in the state in which the temperature of the area D of the side tube part 11*a* is less than or equal to the softening point of the material of the side tube part and is greater than or equal to the annealing temperature, vibration is applied to this side tube part 11*a*. This vibration is caused in the directions of the arrows in FIG. 5(*d*). The reason for this is that the area D of the side tube part 11 is in the plastic flow state and the electrode 2 and the quartz glass 11 move relative to one another. Vibration takes place, for example, one to ten times, resulting in movement of 0.1 mm to 1.0 mm. In the last vibration, the distance between the electrodes must be appropriate. This is done in addition by manual actuation or using an image processing device with an accuracy of ±0.05 mm.

During this vibration, a retaining component 13, which clamps the side tube part 11, is connected to a vibration means, such as a motor or the like. According to the drive of the motor, vibration is formed in the directions of the arrows. Due to this vibration, the electrode and the side tube part 11 necessarily, and moreover in relative terms, diverge from one another, and an intermediate space advantageously forms between the two. When this intermediate space forms, the action could furthermore be observed that the molten quartz glass which is located in the concave areas of the convex-concave part 20 (not shown in the drawings) is influenced by the vibration and is advantageously pressed out.

When the electrode is attached in the side tube part 11*b*, after completion of the above described process, the emission part 10 is filled with mercury and the rare gas which are necessary for lamp operation and the same processes of hermetic sealing, cooling, heating and vibration are carried out for the other side tube part 11*b*.

The frequency of vibration depends on the depth of the convex-concave part which has been formed in the electrode. The inventors confirmed as a result of several tests that, at a convex-concave depth of 35 microns to 100 microns, vibration one to ten times is necessary (the side tube part is subjected to one-time reciprocating motion during a single vibration in the arrow directions as shown in FIG. 5(*d*)), that, at a convex-concave depth of 12 microns to 25 microns, vibration three times to four times is necessary, and at a convex-concave depth of 1.0 microns to 6.5 microns, vibration five times to ten times is necessary. This result means that the smaller the frequency of vibration which suffices, the larger the convex-concave depth. This is also the reason for the influence of the convex-concave part when the intermediate space is formed.

The more frequently the vibration takes place, the more adverse effects can be exerted on the metal foil. The inventors have confirmed that a vibration frequency of at most 10 times, preferably no more than 5 times, is preferred with respect to the effect on the metal foil.

The convex-concave part which is to be formed in the electrode is not limited to the arrangement according to the above described embodiment, in which the concave areas and the convex areas are located bordering one another in the direction in which the electrode extends. This means that an arrangement is also possible in which the concave areas and the convex areas are located bordering one another in the circular peripheral direction of the electrode. In this case, the vibration is applied, not from the end of the side tube part, as was described above in the production process, but it is applied from the side of the side tube part. The convex-concave parts which have been formed in the circular peripheral direction of the electrode, instead of in the entire circular peripheral direction in conjunction with the direction in which the vibration is applied, can be formed in one part.

Another aspect of the invention is described below.

Figure 11:
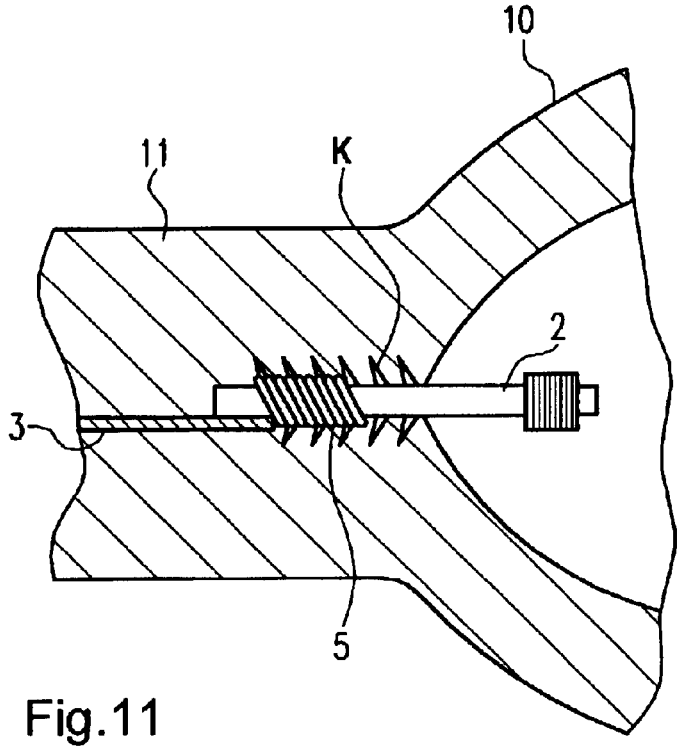
Fig.11 (Prior Art)
FIG. 11 shows a partial view of a conventional super-high pressure discharge lamp of the short arc type.
Figure 12:
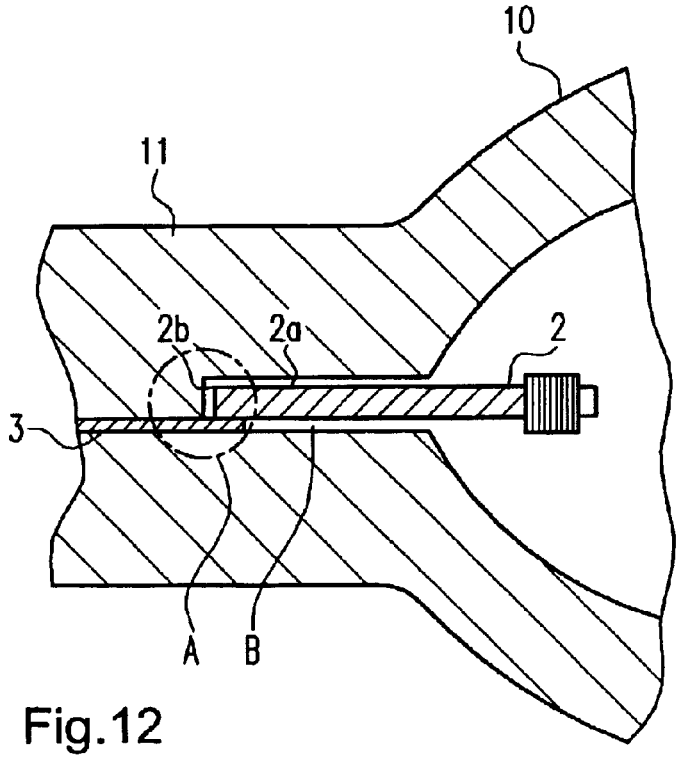
Fig.12 (Prior Art)
FIG. 12 shows a partial view of another conventional super-high pressure mercury lamp of the short arc type.
Figure 13B:
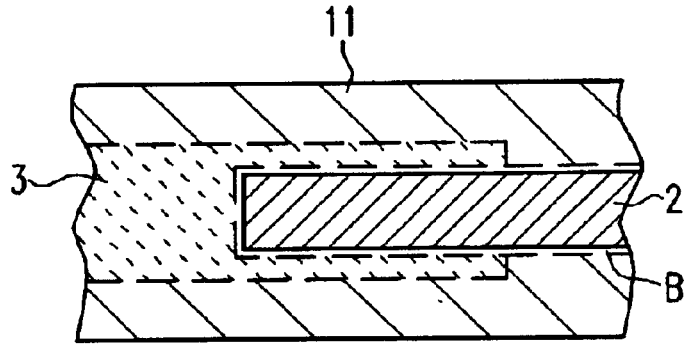
Fig.13(b) (Prior Art)
FIGS. 13(*a*) to 13(*c*) each show a partial view of the encircled region A of FIG. 12.
Figure 13C:
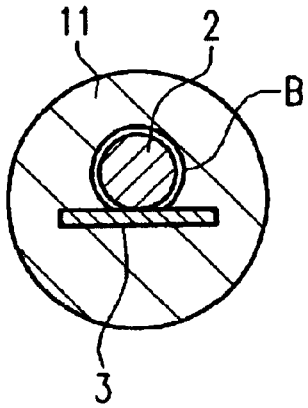
Fig.13(c) (Prior Art)
Figure 13A:
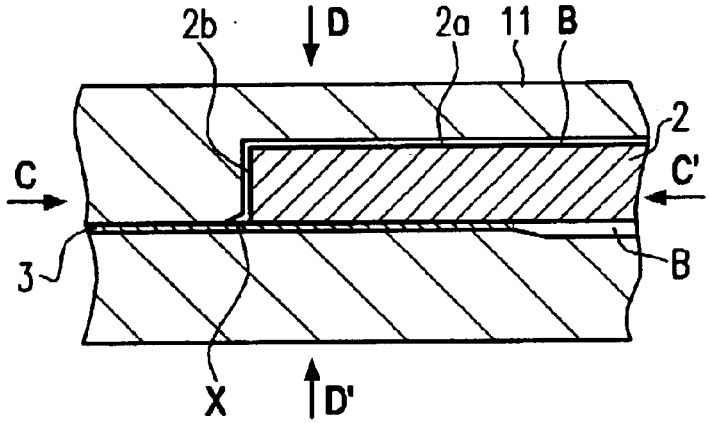
Fig.13(a) (Prior Art)

FIG. 6 shows the border area of the emission part 10 and of the side tube part 11 in an enlarged representation which corresponds to FIGS. 11 & 12. In the side tube part 11, the electrode 2 is welded in the area in which it is welded to the metal foil 3. In the remaining area between the electrode 2 and the quartz glass of which the side tube part 11 is formed, there is an intermediate space B. Specifically the electrode 2 on its side 2*a* and the end face 2*b* on the hermetically sealed side are not in contact with the quartz glass of which the side tube part 11 is formed. The metal foil 3 and the intermediate space B are in reality extremely small or thin. However, in the drawings they are shown exaggerated for the sake of description of the invention. FIGS. 7(*a*), 7(*b*), & 7(*c*), likewise, show the end 2*b* of the electrodes and correspond to FIGS. 13(*a*), 13(*b*) & 13(*c*). FIG. 7(*a*) is an enlarged representation of the end of the electrode. FIG. 7(*b*) is a cross section in which the cross section C—C' as shown in FIG. 7(*a*) was viewed from the top (direction of arrow D). FIG. 7(*c*) is a cross section in which the cross section D—D' as shown in FIG. 7(*a*) was viewed from the left side (direction of arrow C).

Here, the intermediate space B is fixed in the respect that, as a result of the difference between the coefficient of expansion of the material comprising the above described electrodes, and the coefficient of expansion of the material of which the side tube parts are made, the electrodes are not constricted in the axial direction, but can freely expand. In the case in which the electrodes are made of tungsten and the side tube parts are made of quartz glass, the width of the intermediate space B is chosen to be in the range of from 6 microns to 16 microns. The intermediate space B in the lengthwise direction of the electrode is 3 mm to 5 mm. The outside diameter of the side tube part of the electrode is, for example, 0.4 mm to 1.3 mm.

The formation of cracks can be advantageously prevented by the formation of such an intermediate space B even with relative motion of the electrodes and the quartz glass relative to one another.

Furthermore, in this invention, the end face of the electrode 2 does not have the flat end face shape shown in FIG. 12, but tapered so that the end face of the electrode and the metal foil are at an acute angle relative to each other. This arrangement makes it advantageously possible to achieve the above described technical task which arises due to the arrangement of the intermediate space B, i.e., prevention of the formation and growth of an unwanted, wedge-shaped intermediate space X.

Figure 8:
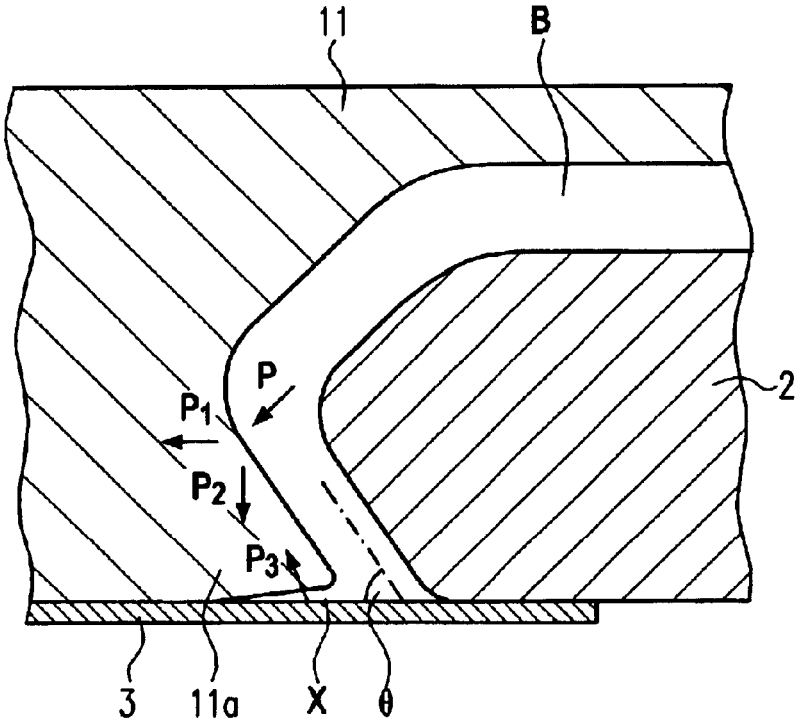
FIG. 8 shows a partial view of a super-high pressure discharge lamp of the short arc type in accordance with a third embodiment of the invention.

FIG. 8 is an enlarged representation of the arrangement of the end of the electrode. As shown in FIG. 8, the end of the electrode does not have a flat end face (there is no plane perpendicular to the lengthwise direction of the electrode), but it is made spherical or curved. In this way, the intermediate space B which has been formed in the vicinity of the electrode is also formed essentially in the same shape.

The end of the electrode and the metal foil 3 are at an acute angle relative to one another. Quartz glass also enters into this acute-angled arrangement, as is shown in FIG. 8 at 11*a*. Here, "acute-angled arrangement" means the angle θ in the drawings which is formed by the end face of the electrode in the intermediate space B and by the metal foil 3. A high pressure P from the intermediate space B is exerted on the quartz glass 11*a* in the directions of the arrows shown in the drawings. This pressure P is divided by the angle θ into a force component $P_1$ and a force component $P_2$. The force component $P_2$ acts in such a way that the quartz glass 11*a* and the metal foil 3 are arranged directly tightly adjoining one another. This action can advantageously eliminate the defect of detachment from this area.

In this invention, the above described unwanted wedge-shaped intermediate space does not form due to the concept of the end face arrangement of the electrode 2. It is therefore possible to advantageously eliminate the defect of detachment of the metal foil which is caused by the wedge-shape intermediate space. Assuming that the wedge-shaped intermediate space X is formed in the production stage, formation of the defect can be suppressed, since the force $P_2$ with which the two are arranged directly tightly adjoining one another, acts more strongly than the force P with which the quartz glass and the metal foil are detached from one another.

Figure 9A:
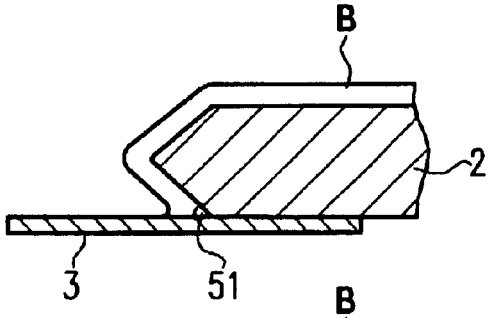
FIGS. 9(*a*) through 9(*c*) show schematics of other embodiments of a super-high pressure discharge lamp of the short arc type in accordance with the invention.
Figure 9B:
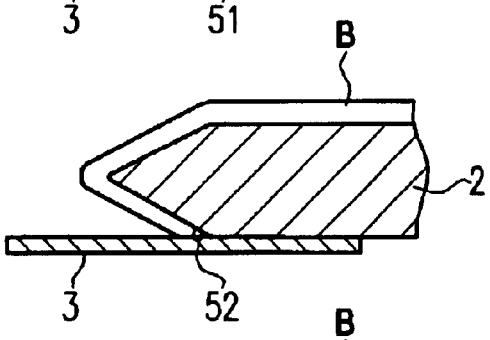
Figure 9C:
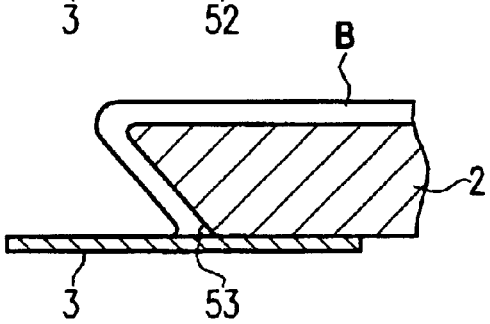

The arrangement of the end of the electrode and the acute-angled arrangement which is formed by the end of the electrode and the metal foil is not limited to the arrangement shown in FIG. 8. FIGS. 9(*a*), 9(*b*) & 9(*c*) show other acute-angled arrangements. In FIGS. 9(*a*) & 9(*b*), the end of the electrode is made conical. The acute angle θ at the point of contact 51 with the metal foil in FIG. 9(*a*) is 45°. The acute angle θ at the point of contact 52 with the metal foil in FIG. 9(*b*) is 30°. Furthermore, the shape which is shown in FIG. 9(*c*) and which is formed by obliquely cutting off the cylindrical electrode can be used. In FIG. 9(*c*) the acute angle θ at the point of contact 53 is 45°.

The acute-angled arrangement which is formed on the end of the electrode is not limited to these embodiments, but other arrangements can also be used. Different angles can also be used with respect to the angle which is formed in the acute-angled arrangement.

Figure 10:
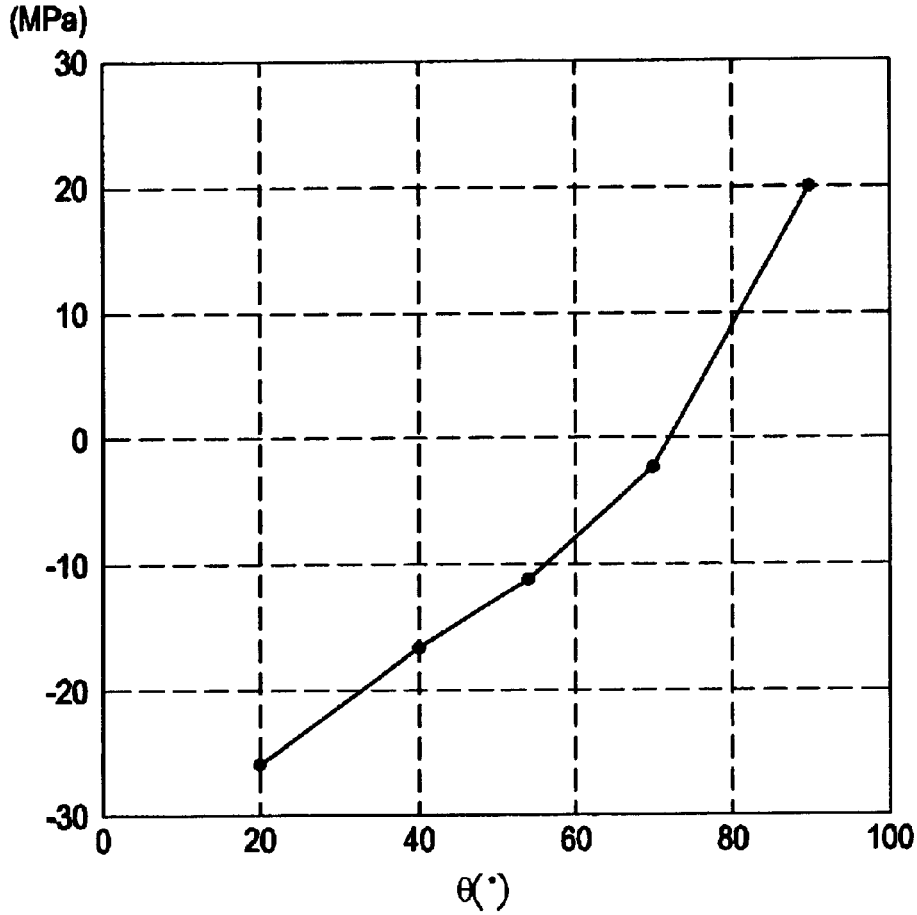
FIG. 10 is a graph showing the results of tests performed with the invention.
Figure 14:
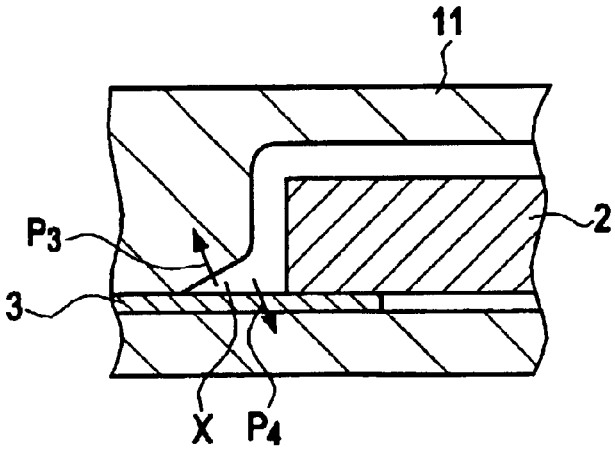
Fig.14 (Prior Art)
FIG. 14 shows a partial view of another known super-high pressure discharge lamp of the short arc type.

Next, in the arrangement shown in FIG. 8, i.e., in the acute-angled arrangement which is formed by the end face of the electrode and the metal foil, the relationship between the acute angle θ and the force component was checked. In this arrangement and in the other studies, discharge lamps with the following properties are used, without the invention being limited to these discharge lamps:

Outside diameter of the cathode: 0.8 mm
Outside diameter of the anode: 1.8 mm
Outside diameter of the side tube part: 6.0 mm
Total length of the lamp: 65.0 mm
Length of the side tube: 25.0 mm
Inside volume of the arc tube: 0.08 $cm^3$
Distance between the electrodes: 2.0 mm
Nominal luminous voltage: 200 W
Nominal luminous current: 2.5 A
Amount of mercury added: 0.15 $mg/mm^3$
Rare gas: 100 torr argon In FIG. 10 the x-axis plots the angle θ, and data were collected in the range from 20° to 90°. The y-axis plots, in MPa units, the unwanted force component which forms in the wedge-shaped intermediate space, i.e., $P_3$ in FIG. 8 and FIG. 14. An angle θ of 90° means the conventional arrangement of the end face of the electrode shown in FIGS. 13(*a*), 13(*b*), & 13(*c*). The relationship shown in FIG. 10 illustrates that, at an angle θ of less than 70°, the unwanted force component which forms in the wedge-shaped intermediate space is negative. This means that in the acute-angled arrangement defined by the angle θ, the stress $P_2$ becomes higher than the stress $P_3$ when the angle θ is less than 70°, with the stress $P_3$ the metal foil and the quartz glass being detached from one another and with the stress $P_2$ the two being arranged directly tightly adjoining one another. It is clearly shown that the stress $P_3$ becomes smaller, the smaller the angle θ.

Furthermore, it also becomes apparent that the action of the invention appears more clearly when the angle θ is less than 70°, and that the action becomes greater, the smaller the angle θ becomes, i.e., from 55°, 40° to 20°. In the case of the angle θ of greater than 70°, the difference between $P_3$ and $P_2$ can also be reduced even more than in the case of an angle θ of 90°, even if the stress $P_3$ cannot be made smaller than the stress $P_2$.

The above described relationship differs, depending on the conditions, such as the size of the intermediate space B, the area of the end face of the electrode, the internal pressure of the discharge space and the like, if they are interpreted precisely. For the numerical value "70°" of the above described angle θ, these conditions must be considered. However, the inventors have confirmed by various tests that essentially the same effect is obtained when the mercury vapor pressure is greater than or equal to 150 atm, the intermediate space B is 6 microns to 16 microns, and the angle θ is 70°. The acute-angled arrangement of the invention which is formed by the electrode and the metal foil can be advantageously used for either the anode or the cathode of the discharge lamp, and preferably, for both electrodes.

As was described above, the super-high pressure discharge lamp of the short arc type in accordance with the invention has an extremely small intermediate space on the sides and the end faces of the electrodes. Therefore, the formation of extremely small cracks in these areas can be completely or essentially completely suppressed. Furthermore, an extremely small intermediate space can be formed in the processes of producing the discharge lamp exactly and reliably by the arrangement of the concave-convex parts in the electrodes. Furthermore, an acute-angled arrangement can be formed between the end face of the electrode and the metal foil. Therefore, the formation and growth of the wedge-shaped intermediate space in this area can be advantageously suppressed.

What we claim is:

1. Super-high pressure discharge lamp of the short arc type, comprising:

an emission part containing a pair of opposed electrodes, each of which has a side section and an end face, and which is filled with at least 0.15 mg/mm$^3$ mercury; and side tube parts made of quartz glass extend from opposite sides of the emission part and the side section and end face of a respective electrode are partially hermetically enclosed in each side tube part;

wherein the electrodes are arranged in side tube parts with a small intermediate space formed between the side sections and the end faces of the electrodes and the quartz glass of which the side tube parts are made; and wherein side parts of the electrodes have at least partially concave-convex areas in the side tube parts.

2. Super-high pressure discharge lamp of the short arc type as claimed in claim 1, wherein the small space has dimensions, based on a difference between a coefficient of expansion of the material of which the electrodes are made and a coefficient of expansion of the quartz glass of which the side tube parts are made, which enable the electrodes to freely expand in an axial direction.

3. Super-high pressure discharge lamp of the short arc type as claimed in claim 1, wherein the concave-convex areas have a depth from 1.0 micron to 100 microns.

4. Super-high pressure discharge lamp of the short arc type as claimed in claim 1, wherein the concave-convex areas have a rectangular shape.

5. Super-high pressure discharge lamp of the short arc type as claimed in claim 1, wherein the concave-convex areas have a zig-zag shape.

6. Super-high pressure discharge lamp of the short arc type as claimed in claim 2, wherein the small space has a width in a range of 6 microns to 16 microns.

7. Super-high pressure discharge lamp of the short arc type as claimed in claim 6, wherein the small space has a length in a range of 2 mm to 5 mm.

8. Super-high pressure discharge lamp of the short arc type as claimed in claim 2, wherein the small space has a length in a range of 2 mm to 5 mm.

9. Super-high pressure discharge lamp of the short arc type as claimed in claim 1, wherein the end face of the electrodes is rounded.

10. Super-high pressure discharge lamp of the short arc type as claimed in claim 2, wherein the end face of the electrodes is rounded.

11. Super-high pressure discharge lamp of the short arc type as claimed in claim 1, wherein each side section is joined to a metal foil which extends axially beyond the end face of the respective electrode; and wherein the end face of each metal foil adjoins the end face of the respective electrode at an acute angle.

12. Super-high pressure discharge lamp of the short arc type, comprising:

an emission part containing a pair of opposed electrodes, each of which has a side section and an end face, and which is filled with at least 0.15 mg/mm$^3$ mercury; and side tube parts made of quartz glass extend from opposite sides of the emission part and the side section and end face of a respective electrode is partially hermetically enclosed in each side tube part;

wherein the electrodes are arranged in side tube parts with a small intermediate space formed between the side sections and the end faces of the electrodes and the quartz glass of which the side tube parts is made; wherein each side section is joined to a metal foil which extends axially beyond the end face of the respective electrode; and wherein the end face of each metal foil adjoins the end face of the respective electrode at an acute angle.

13. Super-high pressure discharge lamp of the short arc type as claimed in claim 12, wherein the electrodes taper in an area of the end faces.

14. Super-high pressure discharge lamp of the short arc type as claimed in claim 12, wherein the electrodes are beveled in an area of the end faces.

15. Super-high pressure discharge lamp of the short arc type as claimed in claim 12, wherein said acute angle is at most 70°.

16. Super-high pressure discharge lamp of the short arc type as claimed in claim 12, wherein a portion of the quartz glass of the side tube parts is arranged between the electrode and the metal foil in the area of the acute angle.

17. Super-high pressure discharge lamp of the short arc type as claimed in claim 12, wherein the intermediate space in an area of the end face of the electrodes has a shape which essentially follows the shape of the end face.

* * * * *